United States Patent [19]

Geibig et al.

[11] Patent Number: 4,553,063

[45] Date of Patent: Nov. 12, 1985

[54] ELECTRICAL DISCHARGE ELECTRODE AND METHOD OF PRODUCTION THEREOF

[75] Inventors: Karl F. Geibig, Sandhausen; Adolf Schwab, Karlsruhe-Durlach; Dieter Stöckel, Birkenfeld, all of Fed. Rep. of Germany

[73] Assignee: G. Rau GmbH & Co., Pforzheim, Fed. Rep. of Germany

[21] Appl. No.: 530,884

[22] Filed: Sep. 9, 1983

[30] Foreign Application Priority Data

Sep. 10, 1982 [DE] Fed. Rep. of Germany ..... 3233584

[51] Int. Cl.[4] ..... A47B 88/00

[52] U.S. Cl. ..... 313/325; 313/311; 313/355; 313/329; 361/120

[58] Field of Search ..... 313/325, 352, 311, 346 R, 313/355, 345, 329; 361/120, 214

[56] References Cited

U.S. PATENT DOCUMENTS

| | | | |
|---|---|---|---|
| 2,369,569 | 2/1945 | Hulbert | 313/329 X |
| 2,786,957 | 3/1957 | Huber | 313/346 R |
| 3,676,743 | 7/1972 | Bahr et al. | 361/120 |

*Primary Examiner*—Robert Lindsay

*Attorney, Agent, or Firm*—Wenderoth, Lind & Ponack

[57] ABSTRACT

An electrode is made of a metallic composite material including a matrix with embedded tubes having high burn-off resistance. A filler material, which differs from the material of the matrix and tubes, is used as a core material for the tubes. Such filler material promotes the emission of electrons from the electrode surface.

16 Claims, 2 Drawing Figures

ELECTRICAL DISCHARGE ELECTRODE AND METHOD OF PRODUCTION THEREOF

BACKGROUND OF THE INVENTION

The invention relates to an electrode for an electrical discharge gap and consisting of a metallic composite material wherein tubes having a high burn-off resistance are embedded in a matrix material of high electrical conductivity and are filled with a core material. An advantageous method of producing such electrode is also provided.

Electrical discharge spaces or gaps are often used as switching means. Other possible uses include the initiation of required combustion processes, the limitation of flash-over voltage and the facilitating of required spark or gas discharges.

For the purpose of these uses, the electrodes are so formed and arranged that an optimum operating range is established and that the necessary ionization of the discharge space occurs at a relatively small voltage difference.

DE-PS 566 633 describes a center electrode of a spark plug wherein wires made of a material, e.g. tungsten, that is difficult to vaporize, are embedded in a matrix material, such as chromium or cobalt, that is relatively easily vaporized. In practice, the more easily vaporized component is first removed so that the projecting tungsten wires cause a corresponding compression of the field and therefore facilitate the ignition process.

A known component for limiting voltage is the noble-gas surge arrestor, the electrodes of which are enclosed in a noble-gas atmosphere (helium, neon, argon, keypton, xenon). In a known arrangement, a radioactive preparation is present in the zone of the discharge space and this preparation pre-ionizes the gas space to an appropriate extent and thus makes it possible for a low ignition voltage and a specific operating range to be obtained. Avoidance of the irradiation of the surrounding area that is associated with this system would be desirable.

SUMMARY OF THE INVENTION

The object of the present invention is to provide an electrical discharge electrode for an electrical discharge gap or space (e.g. a vacuum, gas or liquid discharge space), which electrode, because of its form and/or composition, provides a specific response behaviour without the need for additional irradiation. The characterizing feature of the invention in the case of an electrode of the initially stated kind is regarded as being that the core material consists of a filler material which differs from the matrix and tube material, and promotes the emission of electrons from the electrode surface.

The main consideration is that of introducing into the tube material a metallic and/or non-metallic filler material which promotes the emission of electrons on account of reduced electron affinity of the filler material and of a special cathode effect (electrical double layer, hollow cathode, etc.). It is possible to optimize the response behaviour of spark-gaps by means of such an arrangement, since materials of low electron affinity, for example, can be intentionally implanted at areas of increased electrical field strength. The resultant improvement in the emission conditions means that optimization of the static and dynamic response behavious of the spark-gap can be expected. A particular advantage resides in the long-term constancy of the response behaviour. With the electrodes made of tubular composite material, as proposed in the present invention, the surface portion of the filler materials, which promote electron emission, remains constant even after the spark-gap has responded.

In a further advantageous form of the invention, the filler material may contain at least one component having a lower electron affinity than the matrix and tube material. The use of a filler material that contains at least one component from the group comprising alkaline an/or alkaline-earth metals, preferably magnesium or barium, appears to offer advantages.

In a further advantageous system, the filler material contains magnesium, aluminum or a magnesium-aluminum alloy (Elektron).

It may also be of advantage to use an oxide component, for example barium oxide, or an oxide mixture as the filler material.

Another form of the invention may consist in forming an electro-positive surface layer comprising the filler material in combination with the surrounding medium which, in particular, may be in the form of a gas.

For certain applications, wherein response at a low voltage is called for, it may be advantageous also to add a radioactive component to the filler material. Although this causes the initially mentioned disadvantages whereby the surrounding area is adversely affected, it is found that, because of the favourable electrode properties, radioactive additional materials having a low radiation energy can be used, so that the undesirable effect on the surrounding area is considerably reduced.

In yet another advantageous form of the invention, the tube material may consist of a stainless refined steel, i.e. it may contain tungsten. A large number of tubes, more than thirty, for example, may be advantageously embedded in the matrix material. In a still further advantageous system, the matrix material can be selectively removed from the electrode surface by etching, for example. In this way a peak effect is achieved in the zone of the filler material. In another advantageous system, the proportion of tube material may be below 40% by wt. of the total finished composite material, and the proportion of filler material may be below 20% by wt. thereof.

In an advantageous method of producing such composite material, tubes, each with a core of filler material, are enclosed in a jacket of matrix material and are jointly plastically shaped to form the composite material.

The use of the features of the invention results in the provision of an electrode for electrical discharge spaces, which electrode possesses properties such that favourable response behaviour with regard to ignition voltage, a specific operating range and long-term stability are obtained.

BRIEF DESCRIPTION OF THE DRAWINGS

A form of construction of the accompanying article of the invention is diagrammatically illustrated in the drawings, in which.

DETAILED DESCRIPTION OF THE INVENTION

Figure 1:
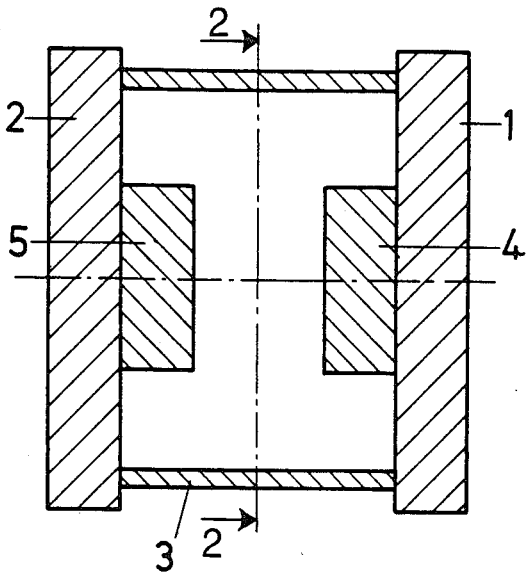
FIG. 1 is a longitudinal section through a spark-gap with electrodes in accordance with the invention.

Referring to FIG. 1, electrodes 4, 5 are mounted on electrode carriers 1, 2, which close off the interior of a tubular spark-gap body 3.

Figure 2:
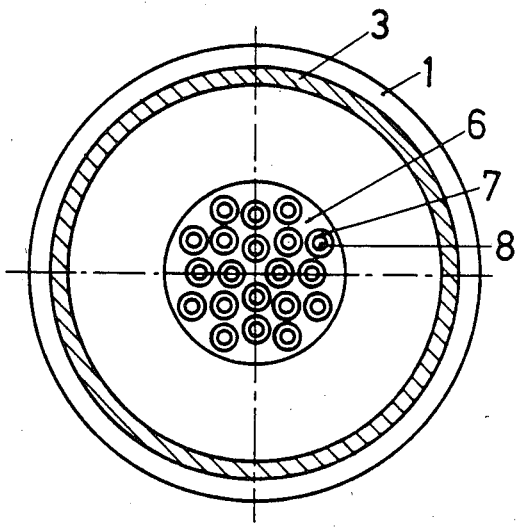
FIG. 2 is a cross-section through the spark-gap along the line 2—2 of FIG. 1.

As shown by the cross-sectional view in FIG. 2, the electrodes, e.g. the electrode 4, each consist of a copper matrix 6, in which are embedded 40 tubes 7 which contain a filler material 8. The tubes 7 are made of a material having a relatively high burn-off resistance, this material being a refined steel in the present example. A magnesium-aluminum alloy (Elektron) is used as the filler material 8.

Prior to their being jointly shaped, the tubes 7 are filled with the fine-grained magnesium-aluminum alloy, are provided with a jacket tube of matrix material (copper) and, as composite bodies, they are plastically shaped by drawing, inter-pass heat-treatment being carried out.

The original diameter of the double-walled tubes is 10 mm, the wall-thickness of the inner tubes of refined steel being 1 mm. The wall-thickness of the copper jacket tubes is 3 mm. The final product, comprising 40 tubes embedded in the matrix, has a diameter of 5 mm.

The electrodes can be arranged relative to the electrode carriers in various ways. For certain applications, a plurality of electrodes may be mounted on a common electrode holder.

We claim:

1. An electrical discharge electrode for an electrical discharge gap, said electrode consisting of:

a metallic composite material including tubes of a metallic material having a high burn-off resistance embedded in and contacting a metallic matrix material of high electrical conductivity and filled with a core material; and said core material consisting of a filler material which differs from said matrix and tube material and which promotes the emission of electrons from a surface of said electrode.

2. An electrode according to claim 1, wherein said filler material contains at least one component having a lower emission energy than said matrix and tube material.

3. An electrode according to claim 2, wherein said filler material contains at least one component from the group comprising alkaline metals and/or alkaline-earth metals.

4. An electrode according to claim 3, wherein said filler material contains magnesium.

5. An electrode according to claim 3, wherein said filler material contains barium.

6. An electrode according to claim 1, wherein said filler material contains aluminum.

7. An electorde according to claim 1, wherein said filler material contains a magnesium-aluminum alloy.

8. An electrode according to claim 1, wherein said filler material contains an oxide component.

9. An electrode according to claim 1, wherein said filler material forms an electro-positive surface layer in conjunction with the surrounding medium.

10. An electrode according to claim 1, wherein said filler material contains a radioactive component.

11. An electrode according to claim 1, wherein said tube material consists of refined stainless steel.

12. An electrode according to claim 1, wherein said tube material contains tungsten.

13. An electrode according to claim 1, comprising more than thirty said tubes embedded in said matrix material.

14. An electrode according to claim 1, wherein said matrix material is selectively removed from said surface of said electrode.

15. An electrode according to claim 1, wherein the proportion of said tube material is less than 40% by wt. and the proportion of said filler material is less than 20% by wt. of the total composite material.

16. A method of producing an electrical discharge electrode consisting of a metallic composite material including tubes of a metallic material having a high burn-off resistance embedded in and contacting a metallic matrix material of high electrical conductivity and filled with a core material consisting of a filler material which differs from said matrix and tube material and which promotes the emission of electrons from a surface of said electrode, said method comprising:

filling said tubes with said filler material;

enclosing the thus filled tubes in a jacket of said matrix material; and jointly plastically shaping said jacket and enclosed, filled tubes, thereby forming said composite material.

* * * * *